US009360283B1

(12) United States Patent
Tejada et al.

(10) Patent No.: US 9,360,283 B1
(45) Date of Patent: Jun. 7, 2016

(54) SHOOTING RANGE TARGET SYSTEM

(71) Applicant: Dynamic Development Group LLC, Ft. Meade, MD (US)

(72) Inventors: Dan Tejada, Ft. Meade, MD (US); Seth Cantrell, Ft. Meade, MD (US); Jean Gagnon, Ft. Meade, MD (US)

(73) Assignee: Dynamic Development Group LLC, Ft. Meade, MD (US)

( * ) Notice: Subject to any disclaimer, the term of this patent is extended or adjusted under 35 U.S.C. 154(b) by 141 days.

(21) Appl. No.: 14/300,965

(22) Filed: Jun. 10, 2014

(51) Int. Cl.

| | |
|---|---|
| ***F41J 1/00*** | (2006.01) |
| ***F41G 3/26*** | (2006.01) |
| ***G06T 7/00*** | (2006.01) |
| ***G06K 9/46*** | (2006.01) |
| ***F41J 5/00*** | (2006.01) |
| ***F41J 5/02*** | (2006.01) |

(52) U.S. Cl.
CPC ..... *F41J 1/00* (2013.01); *F41G 3/2605* (2013.01); *F41J 5/00* (2013.01); *F41J 5/02* (2013.01); *G06K 9/4652* (2013.01); *G06T 7/0097* (2013.01); *G06T 2207/10004* (2013.01); *G06T 2207/10024* (2013.01)

(58) Field of Classification Search
CPC ..... F41J 1/00; F41J 1/10; F41J 5/00; F41J 5/02; F41G 3/26; F41G 3/2627
See application file for complete search history.

(56) References Cited

U.S. PATENT DOCUMENTS

| | | | | |
|---|---|---|---|---|
| 3,330,561 | A * | 7/1967 | Kandel | F41J 5/00 273/378 |
| 3,899,175 | A * | 8/1975 | Loe | F41J 1/00 273/378 |
| 4,137,651 | A | 2/1979 | Pardes et al. | |
| 4,955,812 | A | 9/1990 | Hill | |
| 6,322,365 | B1 | 11/2001 | Shechter et al. | |
| 6,875,019 | B2 | 4/2005 | Huang | |
| 8,162,319 | B2 | 4/2012 | Stincelli | |
| 8,620,464 | B1 | 12/2013 | Weiland et al. | |
| 2011/0217678 | A1 | 9/2011 | Shin | |
| 2013/0341869 | A1 | 12/2013 | Lenoff | |

FOREIGN PATENT DOCUMENTS

| | | |
|---|---|---|
| WO | WO2009147303 | 12/2009 |
| WO | WO2013005064 | 1/2013 |

OTHER PUBLICATIONS

Practiscore User Guide. http://dl.dropboxusercontent.com/u/13935743/PractiScoreManual.pdf Oct. 30, 2011.
Automated Target Scoring & Reporting System Apr. 15, 2014.

* cited by examiner

*Primary Examiner* — Timothy A Musselman
(74) *Attorney, Agent, or Firm* — William G. Giltinan; Carlton Fields Jorden Burt, PA

(57) ABSTRACT

A shooting range target system comprises one or more target modules, a server, a range master's display and a shooter's display. Target modules utilize a digital camera and a processor to automatically detect shot locations and communicate them to the server. Target modules may optionally deploy and retract targets and otherwise move targets based on commands received from the server. Shooter's scores are calculated and stored on the server, and displayed to the shooters on shooters' displays and optionally to a range safety officer on a range master's display.

28 Claims, 11 Drawing Sheets

SHOOTING RANGE TARGET SYSTEM

BACKGROUND

The present invention relates to a system for scoring the performance of shooters at a target range. A preferred embodiment of the shooting range target system of the present invention is adapted for use on ranges used by military, law enforcement, and other groups that require their participants to demonstrate weapons proficiency through a scored test or simulation. Such scores are typically determined based on the number of times the shooter hits the target and the location of those hits. While some such tests utilize static targets, others may require targets that appear and disappear at different times and at different locations throughout the test.

The most common method of scoring shooter proficiency tests is to have a person in protected location deploy, retract and score the target. This practice is, however, labor intensive and typically results in a delay while results are tallied before being reported to the shooter or the range master. Other prior art systems that have attempted to automate shooter proficiency tests have utilized components that are different from what the shooter would typically use in the field such as specialized guns, lasers, or microphones.

One object of the current invention is to address such limitations by providing an automated shooting range target system that allows shooters to use the same equipment utilized in the field; does not require manual deployment, retrieval, and scoring of targets; provides prompt reporting of scores to the shooters and optionally the range master; and does not require expensive high speed photography equipment and does not require expensive radar, sonar, or other types of specialized sensors.

SUMMARY

Disclosed herein are a shooting range target system and a method of detecting hit locations in shooting range targets. A shooting range target system is provided comprising a target module adapted to receive a target having a first layer of a first color and a second layer of a second color. The target module comprises a digital camera adapted to capture images of said target, an optional light source adapted to illuminate or enhance the illumination of the target, and an optional movement sensor in operable connection with the target. A processor is connected to the sensor and to the camera, and to a network interface. Substantially upon a bullet creating a hole through the target, at least a portion of said second layer is made visible to the camera. The illumination of the target by the light source improves the camera's sensitivity to the color of the second layer made visible to the camera. The processor determines the hole location in the target by comparing a before image and an after image generated by the camera and transmits the hole location over a network. Data from the movement sensor may optionally be used to correct for movement of the target between the time of the before image and the time of the after image.

A method is provided for determining a hit location in a target mounted on a target module. The target has a first layer of a first color and a second layer of a second color. The first color is different from said second color and the second color comprises one or more shades of red. The target module comprises a digital camera substantially adapted to photograph the target, a long wavelength infrared light source adapted to illuminate the target, and a processor connected to the camera. The method comprises the steps of causing the camera to take a before image, causing the camera to take an after image, and causing the processor to compare the before image and the after image and to determine the hit location by detecting the appearance of the second color in said after image that did not appear in said before image. The second color is highlighted by virtue of the use of red and the illumination by a long wavelength infrared light source and/or an infrared light source. A movement sensor may optionally be used to correct for movement of the target between the before image and the after image.

BRIEF DESCRIPTION OF THE DRAWINGS

Other features in the invention disclosed herein will become apparent from the attached drawings, which illustrate certain preferred embodiments of certain apparatuses and their component parts, wherein.

DETAILED DESCRIPTION

Figure 1:
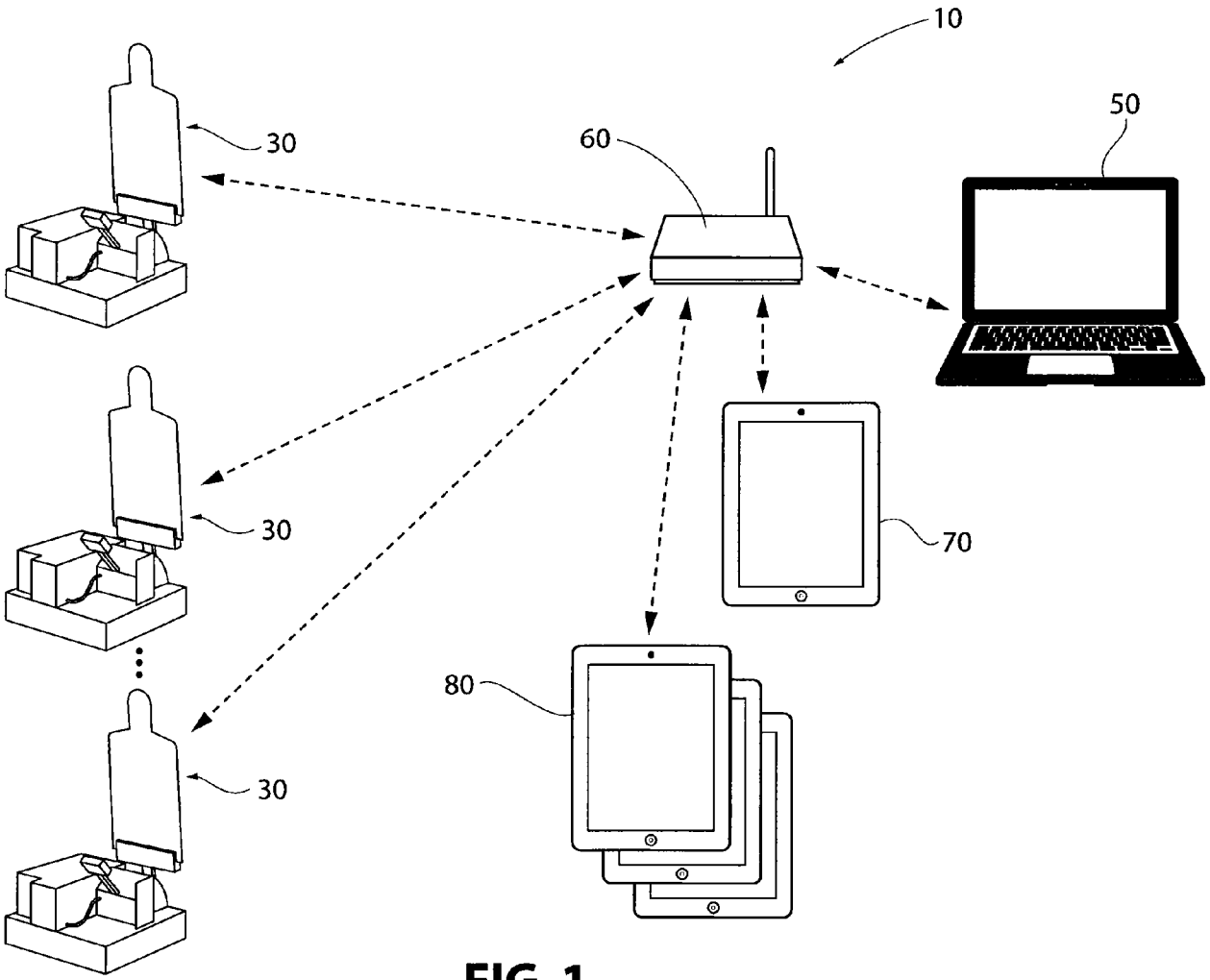
FIG. 1 is a schematic diagram of the high level components of an embodiment of an embodiment of a shooting range target system according to the present invention.

While the following describes preferred embodiments of a shooting range system and scoring method according to the present invention, it is understood that this description is to be considered only as illustrative of the principles of the invention(s) described herein and is not to be limitative thereof. Numerous other variations, all within the scope of the claims, will readily occur to those of ordinary skill in the art.

As used herein, the term "adapted" means sized, shaped, configured, dimensioned, oriented and arranged as appropriate.

The term "programmed," when used in connection with a processor, a device comprising processing capability, means provided with a set of instructions stored in a computer readable media (including without limitation internal memory, flash memory, a CD or DVD, a memory card, a hard disk, a solid state drive, or any other media capable of being read by a computer or similar device) capable of performing an indicated method, process, or task. It will be understood that devices that can be "programmed" include general purpose computers such as laptops, servers, tablet computers (such as an iPad), and mobile phones, as well as specially designed devices containing processors (such as microprocessors, microcontrollers or signal processors or application specific integrated circuits) such as an on-board computer.

As used herein, the term "display" means a device with a screen or other component capable of communicating information to a user. Examples of displays include without limitation tablet computers (such as an iPad or Android tablet), a laptop computer, a desktop computer, and a mobile phone.

As used herein, the term "server" means a general purpose computer, or a specially programmed computer, capable of communicating on a network. Examples of servers suitable for use in embodiments of the present invention include, but are not limited to a laptop computer (such as a Panasonic Toughbook), a desktop computer, a rack mounted computer server, or a mobile device such as a mobile phone or a tablet computer with sufficient memory and processing power to suit the intended purpose of the server.

As used herein, the term "network" means a set of hardware and protocols enabling a plurality of devices to communicate data to one another electronically. Networks can be wired or wireless. Networks can also combine wireless components and wired components. While many networks utilize a router to coordinate network traffic, other networks do not require a centralized router where the routing functionality is performed by the devices on the network. Examples of networks suitable for use with certain preferred embodiments of shooting range target systems according to the present invention include, without limitation, a TCP/IP network utilizing a wireless router and conforming to one of the IEEE 802.11 standards. Other examples of networks suitable for use with certain preferred embodiments of shooting range target systems according to the present invention include, without limitation, Bluetooth or other wireless networks designed to permit device-to-device communication. Networks may include local area networks, personal area networks, or wide area networks, may transmit data in encrypted or unencrypted formats, and may have other authentication or security features as are understood by those of skill in the art.

The term "target" as used herein means a thing at which a shooter shoots and may include, without limitation, paper targets, plastic targets, wood targets, composite targets, metal targets, screens or surfaces on which images are displayed, targets adapted to have the shape of human beings and targets adapted to have geometric shapes.

As used herein, "infrared light source" means a source capable of generating light within the range of approximately 0.7 μm-3.0 μm. One example of an infrared light source includes, without limitation, one or more OptoDiode—OD250, 850 nm infrared Light Emitting Diodes.

As used herein, "long wavelength infrared light source" means a source capable of generating infrared light and visible red light. Embodiments of long wavelength infrared light sources include embodiments made up of multiple light sources, some of which produce visible red light and some of which are infrared light sources.

As used herein, when comparing pixels of a first color to pixels of a second color, the pixels of the first color are a "different color" than the pixels of the second color if the color values of the pixels are mathematically distinguishable. It will be understood, however, that the degree of difference between two colors may depend on the optical characteristics of the camera and the working environment within which the images are captured and converted to pixels. For example, and without limitation, where the working environment is a well-lit indoor shooting range, the first color may be closer to the second color than would be possible in an unlit outdoor shooting range at dust or at night.

As used herein, when comparing pixels in a digital image to identify pixels of a "different color," the term "substantially different color" may be understood as follows. A mean color value may be calculated by averaging the color values for all pixels in an image, or all pixels within a defined portion of an image. Pixels of a "substantially different color" may then be understood to mean pixels that have color values that vary from the mean color value by more than one standard deviation.

The definitions and meanings of other terms herein shall be apparent from the following description, the figures, and the context in which the terms are used.

Referring now to FIG. 1, a preferred embodiment of a shooting range target system 10 is illustrated. One or more target modules 30 communicate over a network with server 50. As illustrated, a wireless local area network utilizing a wireless router 60 implementing an IEEE 802.11 protocol is utilized. In such embodiments all components of shooting range target system 10 can be on a shooting range, within the range of the wireless network. It will be understood, however, that it is also possible to have embodiments in which server 50 or a second range master display 80 are in remote locations and connected via a wide area network.

Range master display 80 as illustrated is a tablet computer such as an iPad. As is further described below, a range safety officer can utilize range master display 80 to initiate a shooting drill and monitor the scores for each shooter and each target module 30. It will be understood that a single target module 30 may be assigned to each shooter, or that a particular drill may require a single shooter to shoot at more than one target module 30 either as part of a timed sequence, or as part of a drill requiring a predetermined number of hits in predefined target zones, or as a combination of timing and hit requirements. In the illustrated preferred embodiment, the range safety officer will select a drill using range master display 80 and server 50 will coordinate the drill sequence.

Individual shooters will shoot at targets mounted on target modules 30. Each target module 30 will determine the location and time of each target hit and will communicate it to server 50 over the network. The location (and optionally the time) of each hit are used by server 50 to calculate a score for each shooter. Hit locations and scores are displayed, preferably in real time and are transmitted from server 50 to shooter displays 70 (which may also conveniently be tablet computers such as iPads), thus enabling each shooter to receive near immediate feedback on their performance. Range master display 80 may conveniently be programmed to display the hit locations and scores of multiple shooters to enable the range safety officer to see an overview of the progression of the drill.

Figure 2:
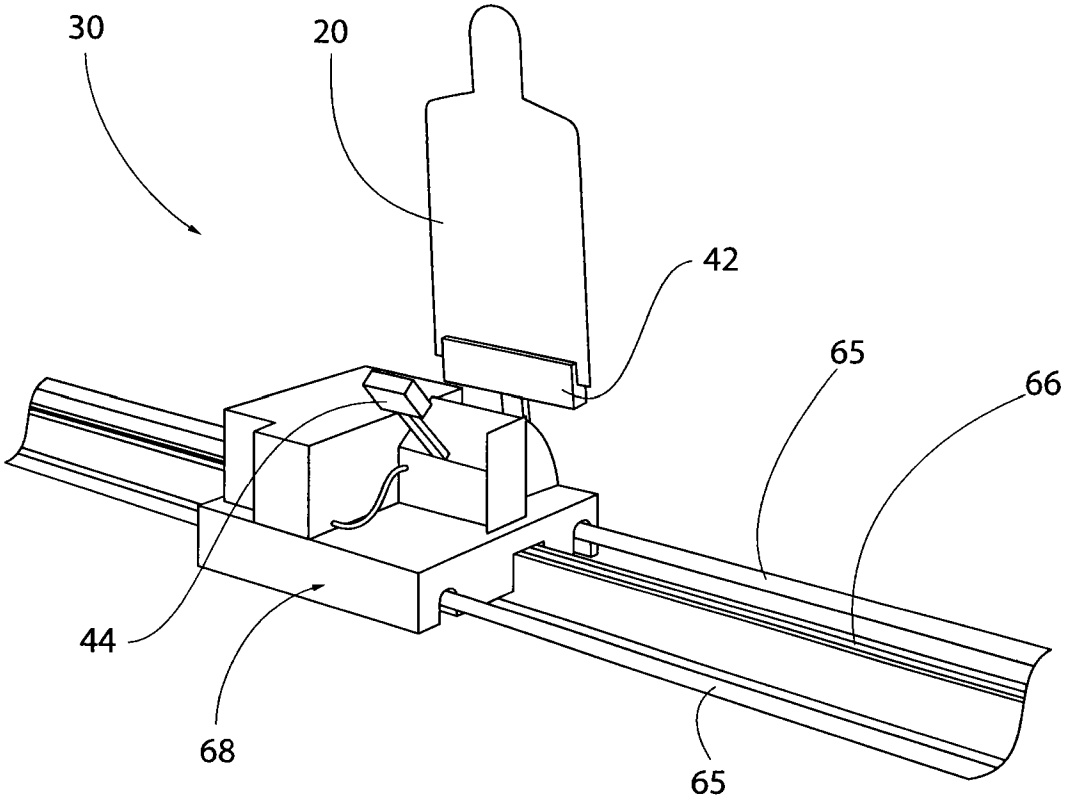
FIG. 2 is a perspective view of an embodiment of a target module suitable for use with the system illustrated in FIG. 1, in which the target module is adapted to move along a track.
Figure 3:
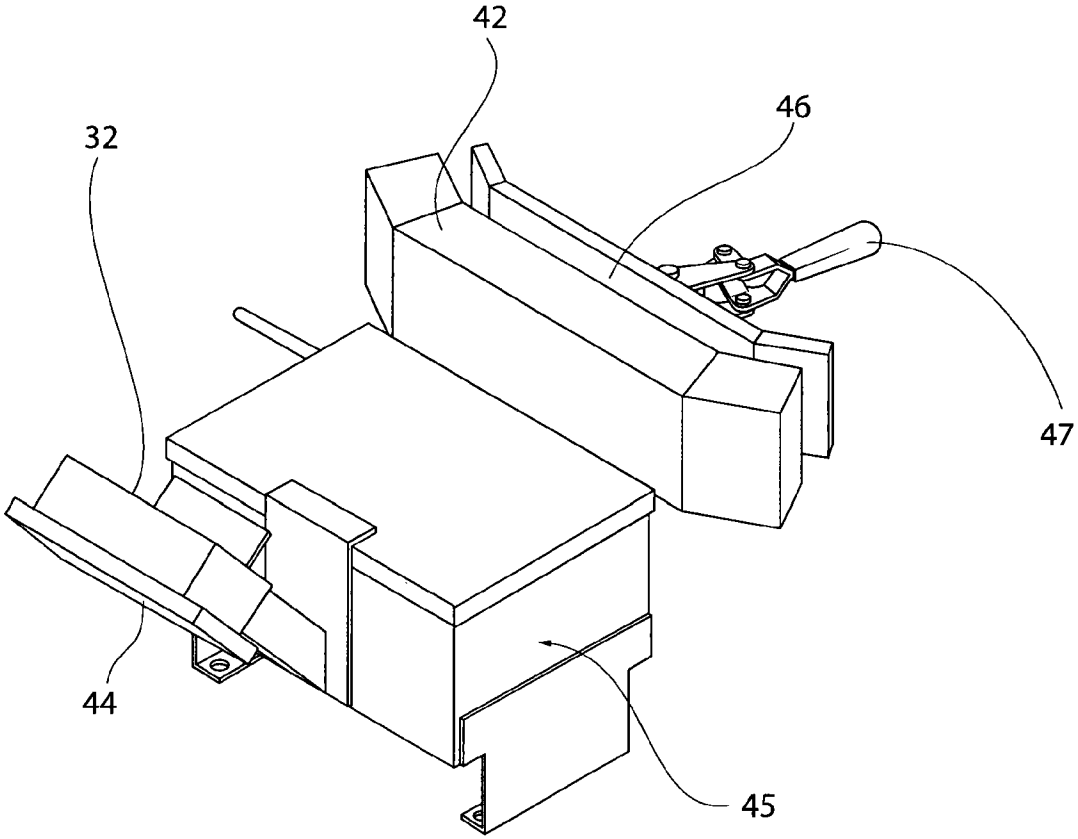
FIG. 3 is an alternate perspective view of the target module embodiment shown in FIG. 2 removed from the track.
Figure 4:
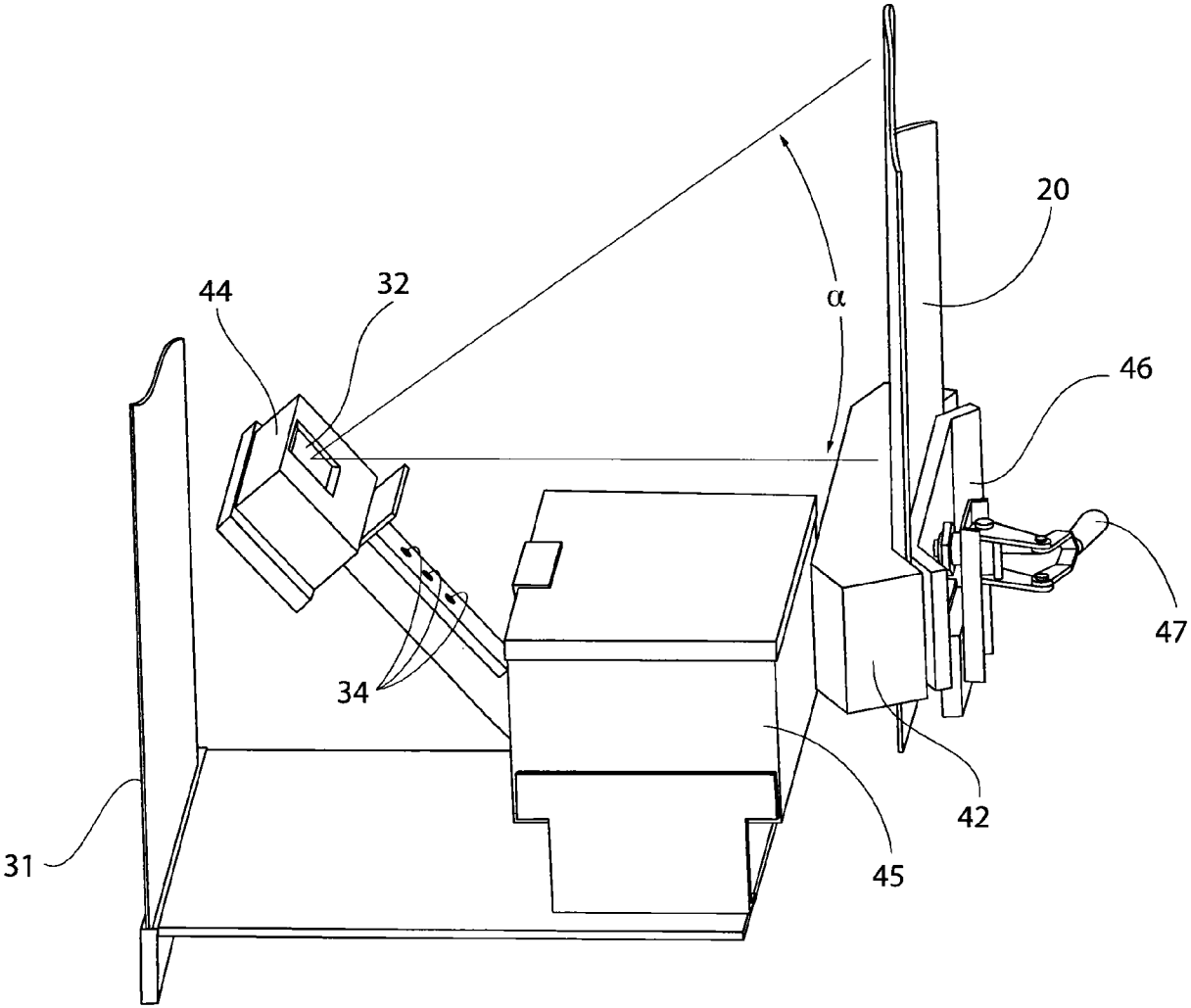
FIG. 4 is an alternate perspective view of the embodiment shown in FIG. 3.

FIGS. 2, 3 and 4 illustrate an embodiment of target module 30 suitable for use with shooting range target system 10. In the embodiment illustrated in FIG. 2, target module 30 is mounted to track module 68. It will be understood, however, that target module 30 could be affixed to any platform or could be mounted to a fixed location if desired. As illustrated, track module 68 (which comprises a motor (not illustrated) powered by two lead acid batteries (also not illustrated)), is adapted to move target module 30 along track 65. As illustrated, track 65 has two rails 67, and a centered track gear 66. Rollers (not illustrated) within track module 68 keep track module 68 aligned on track 65. A gear (not illustrated) within track module 68 is adapted to engage track gear path 66 and moves track module 68 along track 65. An optional rotation sensor (not illustrated) operably connected to the gear (not illustrated) within track module 68 enables precise monitoring of the location of target module 30. It will be understood by those of skill in the art, however, that a wide variety of means may be used to monitor the location of track module 68 including, without limitation, physical sensors or switches mounted at predetermined locations on track 65, GPS, inertial tracking, or simply timing the amount of time during which power is applied. It will also be understood by those of ordinary skill in the art that target module 30 could also be mounted on wheels (not illustrated), at least one of which is connected to a motor (not illustrated) such that target module 30 could move without the benefit of tracks 65. In such embodiments the location of target module 30 could be determined by GPS, inertial tracking, or other location determining techniques known in the art, and the direction of movement of target module 30 could be altered by a steering wheel (not illustrated) or by moving one wheel (not illustrated) ad a different rate than another wheel (not illustrated).

Target module 30 is further illustrated in FIG. 3. Target 20 (shown in FIG. 2) is received in movable mounting 42 and held by a clamping force. The angled ends of movable mounting 42 preferably provide twist to target 20, thereby adding stiffness that resists excessive movement of target 20 during a shooting drill.

Camera mounting module 44 is conveniently positioned below target 20 to be out of the line of fire, and angled such that camera 32 looks up at target 20 at angle $\alpha$. As illustrated, angle is about forty degrees. However, one advantage of the present invention is that it allows angles $\alpha$ of between about twenty degrees and eighty degrees, which in turn allows camera 32 to be mounted in a variety of locations out of the line of fire, and proximate to target 20. Angles between thirty and sixty degrees are convenient in part because they reduce the overall size of target module 30 by allowing camera 32 to be mounted comparatively close to target 20, but still below target 20 and substantially out of the line of fire. It will also be noted that as shown, camera 32 is substantially centered in front of target 20. However, the present invention also allows camera 32 to be mounted to the side of the center line of target 20, including at angles of up to about forty-five degrees, thereby providing further flexibility in sizing and configuring target module 30.

Referring to FIG. 4, an alternate view of target module 30 is shown. As illustrated, optional plate 31 (which may conveniently be an armor or metal plate) provides additional protection to cameral mounting module 44. Long wavelength infrared light sources 34 are adapted to illuminate target 20. In certain embodiments, long wavelength infrared light sources 34 may comprise an infrared light source such as (without limitation) OptoDiode—OD250, 850 nm infrared Light Emitting Diodes. Long wavelength infrared light sources 34 are mounted on a support 41 holding camera mounting module 44, but it will be understood by those of ordinary skill in the art that the selection and location of a suitable light source is a matter of choice provided target 20 is illuminated. Other components of target module 30 may conveniently be housed within target motor module 45 at the base of support 41. Using a hollow structure as support 41 allows electrical connections between target motor module 45 and camera mounting module 44.

Figure 5:
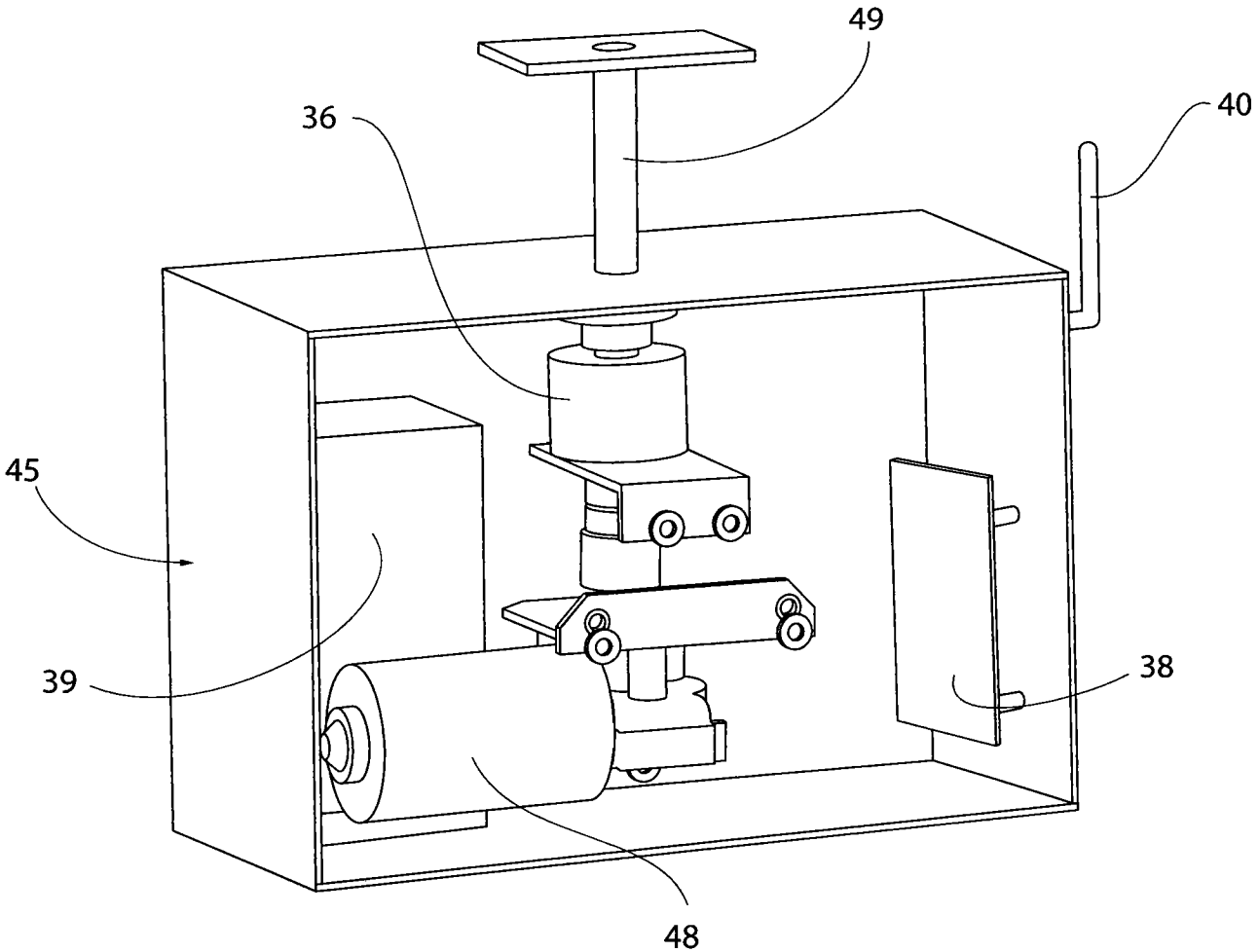
FIG. 5 is a perspective view of the target motor module of the embodiment shown in FIG. 3 with the cover removed to display internal components.

Target motor module 45 is illustrated on FIG. 5, with its cover removed to reveal internal components and separated from target module 30. In certain embodiments (not illustrated), target 20 may be in a fixed location. In the illustrated embodiment, target motor 48 is operably connected to shaft 49, which is adapted to be affixed to movable mounting 42. Activation of target motor 48 will thus rotate movable mounting 42 to deploy and retract target 20 as necessary for a given drill.

As illustrated, processor 38 comprises a single board computer operably connected to camera 32 (shown on FIG. 4), long wavelength infrared light sources 34 (shown on FIG. 4) and target motor 48. Processor 38 may conveniently comprise an Overo FireSTORM COM—GUM3703F onboard computer, with an integrated wireless network interface (not illustrated) operably connected to antenna 40. It will be understood, however, that a variety of hardware may be used for processor 38 and that antenna 40 is not needed if a wired network is utilized. Battery pack 39, which may conveniently be a rechargeable 12 volt, 7.5 Ah lithium ion battery, may conveniently power processor 38, long wavelength infrared light sources 34 (shown on FIG. 4) and target motor 48. In embodiments in which target module 30 is mounted to track module 68 (as shown in FIG. 2), processor 38 may also be conveniently operably connected to a motor controller (not illustrated) within track module 68. However, due to the power requirements of track module 68, it is preferred that the motor (not illustrated) in track module 68 be powered by an independent power source which may conveniently be lead acid batteries (not illustrated) or an external AC power source (not illustrated). In this way, processor 38 may receive images from camera 32, deploy and lower target 20 by controlling target motor 48, control movement of optional track module 68, and receive commands and communicate hit times and hit locations over a network through antenna 40 and an onboard wireless network interface (not illustrated).

Figure 7:
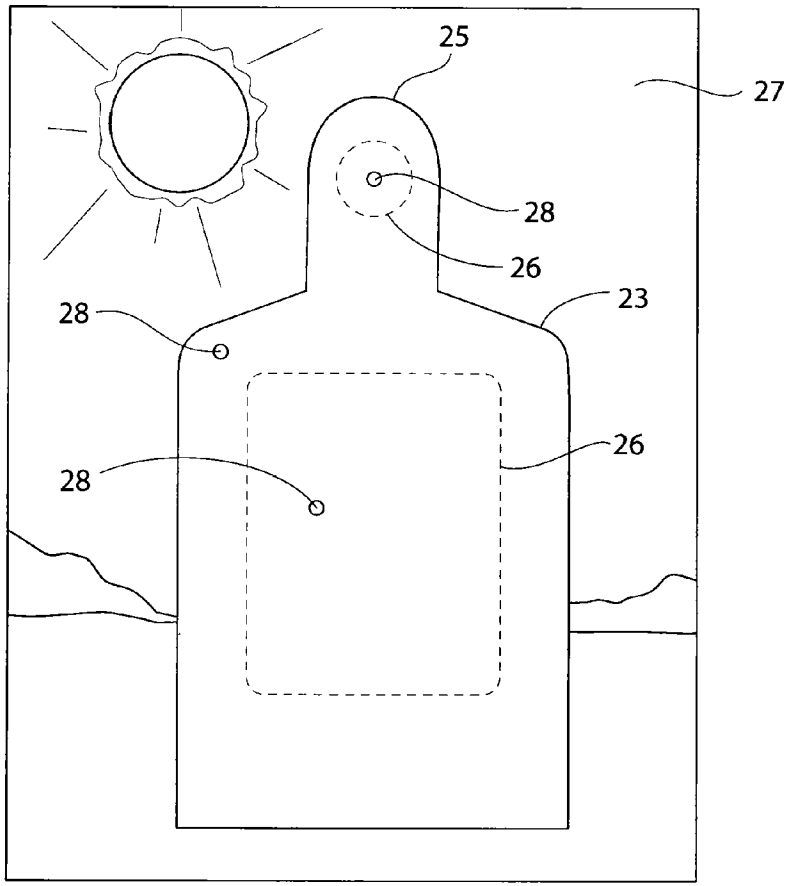
FIG. 7 is a partial side view of the target shown in FIG. 6, cut away to illustrate a typical appearance of target layers around a shot hole.
Figure 6:
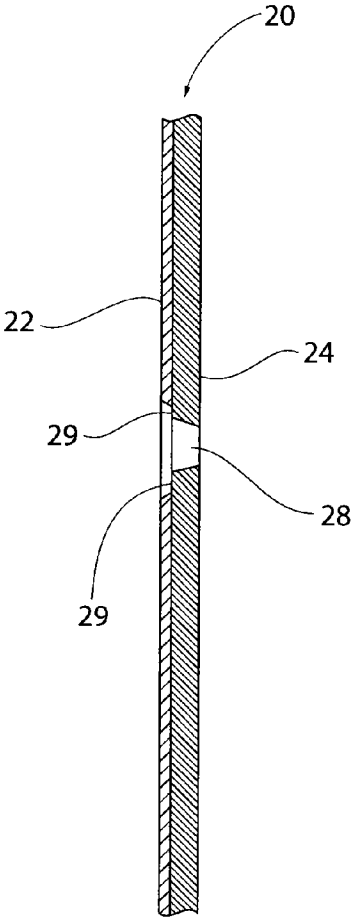
FIG. 6 is a schematic view of a target as seen by the camera utilized in the embodiment shown in FIG. 3.

Processor 38 determines a hit location by comparing a before image and an after image taken by camera 32. FIG. 6 illustrates target 20 as seen by camera 32, and FIG. 7 illustrates a portion of target 20 from the side, cut away at the center of a hole 28. Locations on target 20 can be calculated as X/Y distances from an arbitrary point on target 20 such as, without limitation, the center point of the bottom edge. One or more predetermined target areas 26 can similarly be designated by X/Y coordinates to represent hit locations of higher value (such as kill shots) or lower value (such as wounding shots). In this manner, drills can be constructed that require, for example, a given number of kill shots or wounding shots before a target is retracted or that calculate scores based on the locations of holes 28.

One advantage of the target module of the present invention is that camera 32 can conveniently be a comparatively inexpensive progressive scan digital video camera. Processor 38 can capture each complete frame taken by camera 32 (a before image) and compare it to a subsequent frame (an after image). By subtracting the two images, hits can be detected in the differences between the two images, and hit locations can be determined by calculating physical hit locations from the locations of the changed pixels in the after image.

Accuracy of determination of a hole 28 as a hit location can be improved by highlighting hole 28. Referring to FIG. 7, this may conveniently be accomplished if target 20 comprises a first layer 22 of a first color, and a second layer 24 is of a second color, and the second color is a different color with respect to the first color. As illustrated, second layer 24 is formed of red plastic and first layer 22 is formed of a coat of black paint. When hit by a bullet, hole 28 is formed with a ring 29 of second layer 24 showing through. It will be understood that where ring 29 is illustrated as being substantially circular, oval shapes are possible where target 20 is hit from an angle, and more complex shapes are possible where hits are close together.

The use of a red color for second layer 24, while not required, has the advantage that red is not a commonly occurring natural color in the environments in which most shooting ranges are located. Accordingly, where a green, dark grey or black color is used on first layer 22, a red second color of second layer 24 will be a substantially different color when taking into account both the color of first layer 22 and the color of the portions of the working environment captured in a digital image of target 20. Depending on the working environment, the typical light conditions when the system is in use, and the optical characteristics of camera 32, other colors may also be used. For example, and without limitation, in an indoor range where the working environment is predominantly white, a first color of yellow and a second color of blue, green or black might be used. The illustrated embodiment may conveniently be used in an outside range. Accordingly, given that red is not a common color in the working environments of outside ranges, using red as a second color is convenient.

Additionally, where second layer 24 is of a substantially red color, long wavelength infrared light sources 34 highlight rings 29, thereby improving the accuracy of hit detection, even when using comparatively less expensive, lower resolution, progressive scan cameras for camera 32. Use of an infrared light source instead of, or as part of, long wavelength infrared light sources 34 has a further advantage in that it enables operation in particularly low light conditions such as early dawn, late dusk, or night.

It will be understood that while the illustrated embodiment shows first layer 22 comprising a paint-like coating and second layer 24 comprising red plastic, a variety of two layer structures could be used for target 20 including, without limitation, a dark plastic first layer bonded to a red plastic second layer.

Use of progressive scan video camera for camera 32 presents additional challenges when comparing a first image to a second image in part because the target 20 may move between the two images or between scans of a single image. Movement could be caused by the contact of a bullet, wind, ground movement, etc. In the illustrated embodiment, front-to-back movement (in which the distance between the face of target 20 and the lens of camera 32 varies) and side-to-side movement are accounted for. Referring to FIG. 5, movement sensor 36 is a rotation sensor that detects rotation of shaft 49 generated by side-to-side movement of target 20. While a wide variety of movement sensors may be used, as illustrated movement sensor 36 is a Quadrature Encoder (model HS20.625QZ-1024/5-26CS) available from Photocraft, Inc. Movement sensor 36 is operably connected to processor 38 and provides direct data indicating side-to-side movement of target 20.

Front-to-back movement may conveniently be detected by suitably programming processor 38 to align the before image and after image prior to comparison. As illustrated in FIG. 6, edge detection can be utilized to determine the location of the top edge of the head shape 25 of target 20 and the top edge of the shoulder shape 23 of target 20 in each image. By aligning those edges in the before image and the after image, front-to-back movement can be accounted for. Those of ordinary skill in the art will readily see that other image processing techniques can also be used to correct for movement. Such techniques include, without limitation, detecting different edges and calculating the distance between said edges and the edges of frame 27 viewed by camera 32, utilizing high contrast points at fixed locations on target 20, and comparing distances between edges on target 20 and a horizon or non-moving background reference. In the embodiment illustrated, the combination of image processing to indirectly detect movement in one direction and direct detection of motion in another direction by movement sensor 36 is convenient and computationally efficient.

Figure 9:
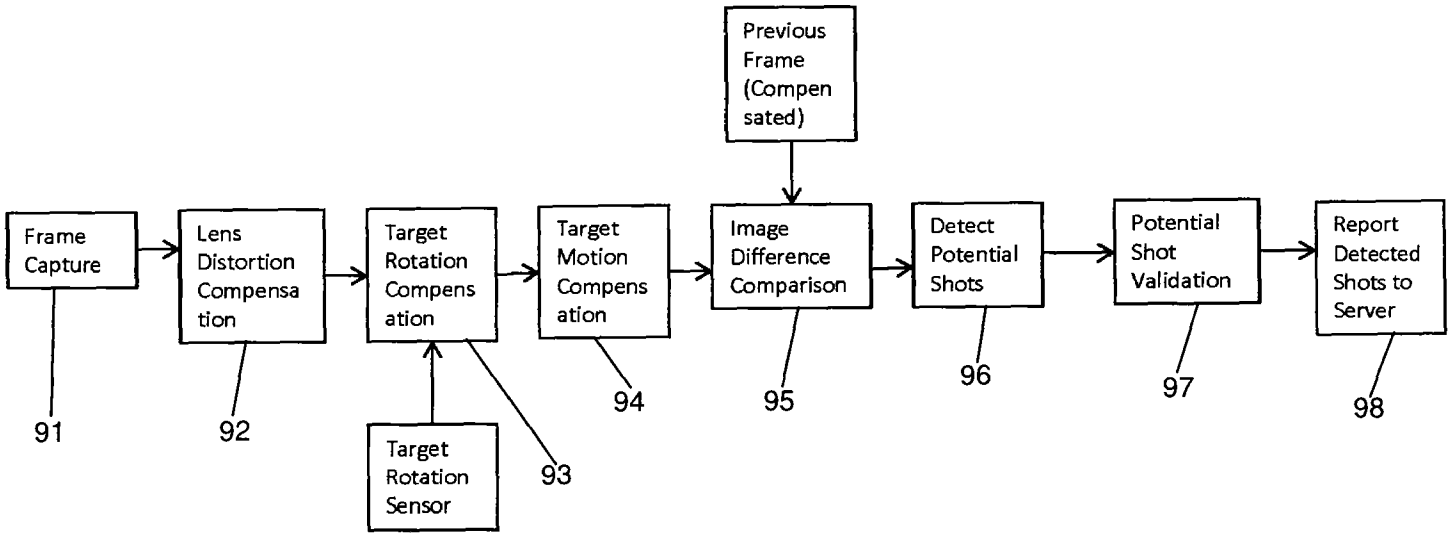
FIG. 9 is a flow chart illustrating a process utilized by an embodiment of a processor suitable for use within an embodiment of a target module suitable for use in the system shown in FIG. 1.

Referring to FIG. 9, it can thus be seen that determining a shot location by comparing a before image frame and an after image frame can be accomplished by a series of steps repeated for each frame. The next frame is captured in frame capture step 91 and lens distortion is compensated for using known image processing techniques in lens distortion compensation step 92. Side-to-side movement is detected and compensated for with input from movement sensor 36 in target rotation compensation step 93. Front-front to back movement is then detected and compensated for with the edge detection method previously discussed in target motion compensation step 94. The compensated image is then subtracted from the previous image in image comparison step 95. Possible holes 28 are then detected by analyzing the differences in detect potential shots step 96. Potential shots are then validated using cross correlation and auto correlation techniques in potential shot validation step 97. In reporting step 98, new shots are reported to server 50 through the network and include the X/Y location of the shot on the target 20 and the time of the detection. All of the foregoing steps can be accomplished by suitably programming processor 38 in light of the foregoing disclosure.

In certain preferred embodiments, images captured by camera 32 may be converted from color to greyscale to facilitate quicker transformations and comparisons. In such embodiments, detection accuracy can be further enhanced by weighting the transformation to greyscale in such a way that emphasizes the second color of second layer 24 and/or deemphasizes the first color of first layer 22. In such embodiments second color of second layer 24 may be merely a different color than the first color of first layer 22 before the greyscale conversion and a substantially different color after the greyscale conversion. It will thus be understood that determining what constitutes a different color and a substantially different color can depend on factors including the predominant colors in the working environment, the characteristics of camera 32, the manner in which target 20 is illuminated, and the nature of any enhancing transformations performed by processor 38 when comparing images. Accordingly where a first color is said to be a substantially different color than a second color, the point of comparison will be understood to be after initial transformations and corrections have been applied, and before a comparison is performed.

Referring to FIG. 1, in the illustrated embodiment, server 50 is responsible for coordinating a predefined drill by sending commands to target modules 30, receiving and storing hit data from target modules 30, and sending hit data and scores to shooter displays 70 and range master display 80. As used herein, a "drill" is a series of commands to be sent to target modules 30 together with a set of scoring parameters. Commands include, without limitation, direction to deploy or retract targets 20 on target modules 30, and, in embodiments including a means of moving one or more target modules 30, commands to move target modules 30. The order and timing of commands may conveniently be based upon durations (for example and without limitation to deploy a given target 20 at a given time and then retract it either at a predetermined later time) or may be based on detection of a number of hits in predetermined target areas (for example and without limitation to retract for the remainder of a drill if a kill shot is detected, or to retract, move and redeploy a target if a wounding shot is detected), etc. A given drill may be for a single shooter, or may involve multiple shooters working in coordination or separately.

Figure 8:
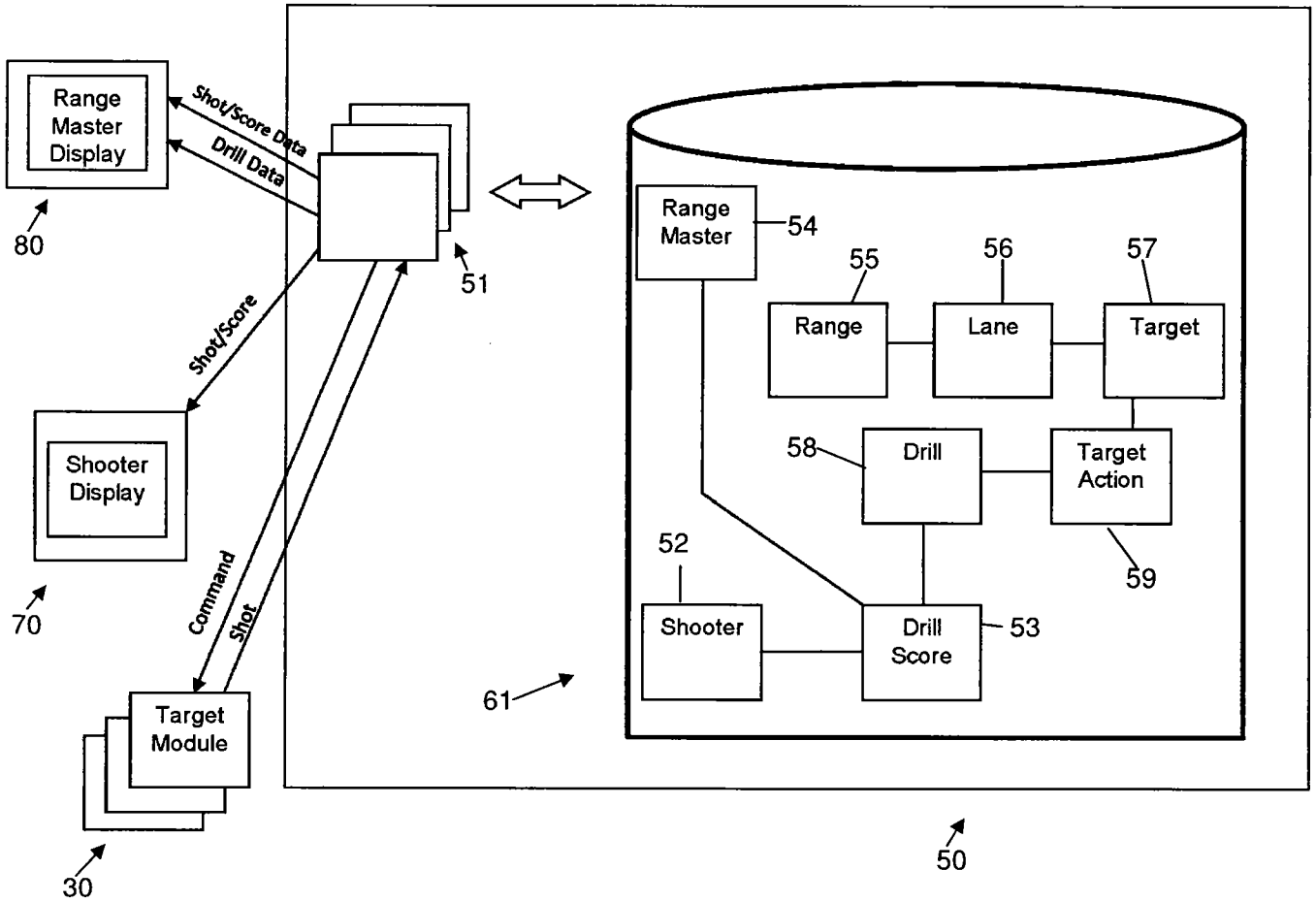
FIG. 8 is a schematic diagram of components in an embodiment of a server suitable for use in the system shown in FIG. 1.

FIG. 8 shows a representation of certain functions that may conveniently be provided by, and data that may conveniently be stored on, server 50 in the illustrated embodiment. Server 50 may be any computing device capable of storing and processing the required data and communicating with target modules 30 via a network. In certain embodiments, a Panasonic Toughbook laptop computer has proven suitable for use as server 50, due in part to its inherent computing and networking capabilities. Its portability and durability can also be convenient when shooting range target system 10 is utilized in an outdoor range that is potentially subject to weather or other conditions that are hostile to traditional laptop computers, desktop computers, and servers.

As is illustrated in FIG. 8, server 50 may conveniently comprise a database 61 (which can be any means of storing and retrieving data including without limitation, a relational database, flat files, an object oriented database, or other database or file system), and one or more programs 51 capable of accessing the data in database 61 and transmitting and receiving information to and from target modules 30, shooter's display 70 and range master's display 80. A variety of software technologies can be used for programs 51 including programs in languages including C, C++, Java, Visual Basic. Some or all of programs 51 may also be provided through internet technologies such as PHP and .NET when combined with a suitable web server.

Database 61 may conveniently store a variety of information relating to shooters, ranges, users, drills, targets and scores. Certain high level categories of stored information are illustrated. When it is desirable to keep a long term record of an individual shooter's scores, or when multiple shooters are participating in a drill, it is desirable for server 50 to store an indication of the identity of a shooter (e.g. a name or login ID), and other information relating to the shooter, may be stored in shooter repository 52. Information relating to a shooter's performance on one or more drills may be stored in drill score repository 53, and may include information such as the date and time of the drill, the range, the lane assigned to the shooter, the drill parameters, and the score achieved.

It can also be desirable to keep information relating to one or more firing ranges in range repository 55 (which may include information such as the name and location of the range), lane repository 56 (which may include an identifier and other information relating to an individual lane or target set at a range), and target repository 57 (which may include information relating to a target within a lane such as the size and location of the target, its deployment state, zones and predefined areas in which hits of a particular type are scored).

Drill repository 58 may conveniently store information relating to a drill such as an identifier for a drill and other information relating to the drill as a whole. Target action repository 59 may conveniently store information relating to how each target is directed to act during a particular drill. For example, and without limitation, target action repository 59 may contain commands indicating when individual targets are deployed and retracted, whether and where a target module 30 should move throughout the drill, or what types (or locations) of hits must be detected for a subsequent action to occur or to achieve a given score.

Range master repository 54 may conveniently store information relating to a range safety officer including, without limitation, a name or user identifier.

As can be seen, storing such information allows server 50 to be preconfigured with information relating to a given range (together with its lanes and targets), a set of users (including shooters and range safety officers), and predefined drills. Once configured, server 50 can then coordinate a drill by sending commands to target modules 30 based on information in target action repository 59 and compile scores for each shooter in drill score repository 53. That information can then be transmitted to range master display 80 and shooter display 70 by programs 51.

It will be understood by those of ordinary skill in the art that a wide range of options exist for organizing and processing data and commands on server 50. The embodiment described herein is just one example of choices that may be made in connection with certain of the high level information groupings that may be stored and processed in connection with the illustrated embodiment.

Figure 10:
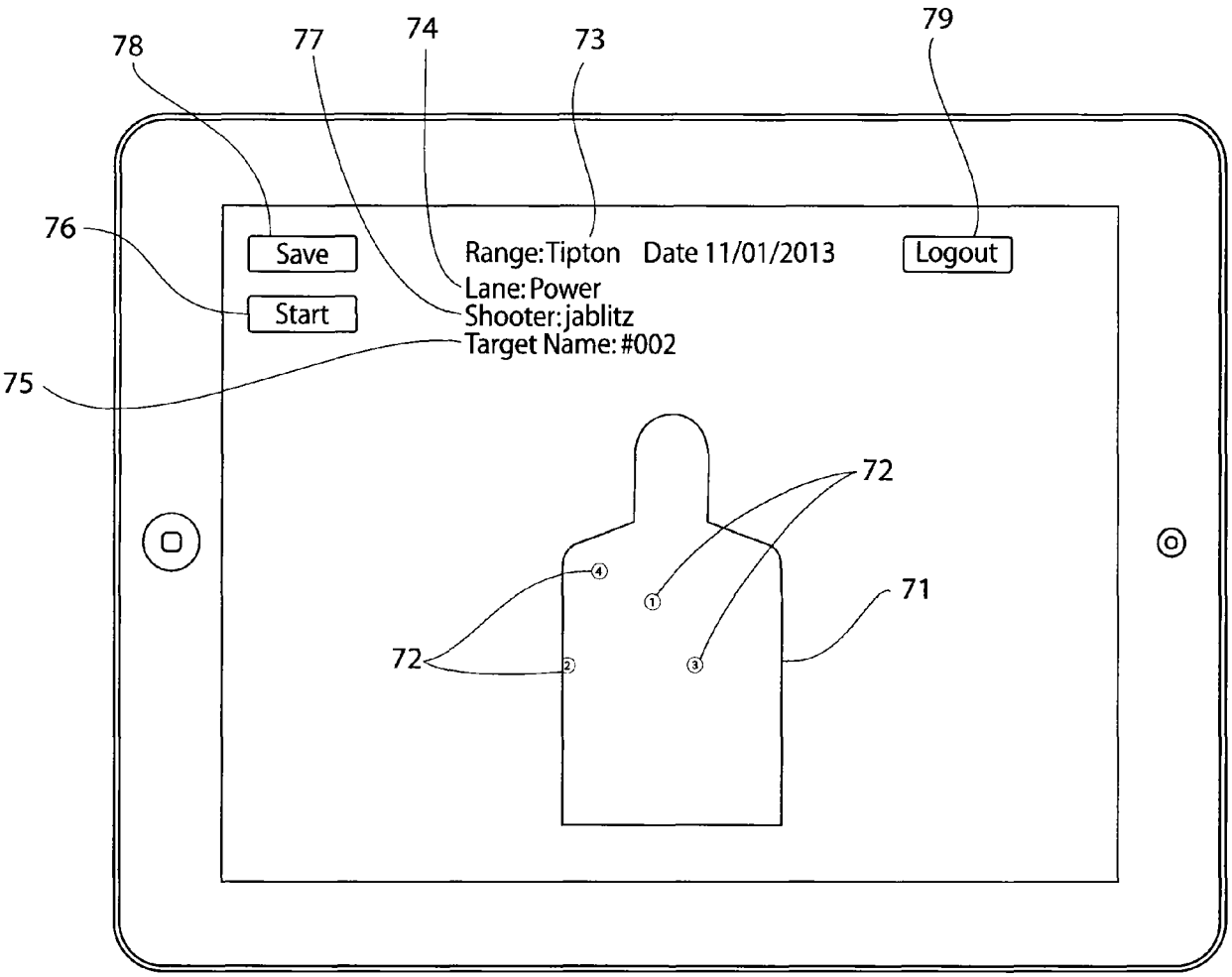
FIG. 10 is a schematic diagram showing the user interface of an embodiment of a shooter display suitable for use in the system shown in FIG. 1.

FIG. 10 illustrates components of a user interface of a shooter's display suitable for use with preferred embodiments of shooting range target systems according to the present invention. Shooter display 70 is preferably a tablet computer such as an iPad or Android tablet, or a network enabled smartphone, adapted to communicate on the same network as target modules 30 (shown on FIG. 1). Tablet computers are utilized in the illustrated preferred embodiment because they are portable, have a convenient form factor, typically comprise a network interface, and because a variety of protective cases are available suitable to protect the tablet computers while being used on an outside shooting range. It will be understood, however, that other types of display may be used for shooter's display 70 including, laptop computers, or dumb terminals connected to a server, personal computers, smart phones, and custom devices. All that is required is that shooter's display 70 be a device capable of communicating on the same network as target modules 30 (shown on FIG. 1) and server 50 (also shown on FIG. 1), and capable of displaying hit results. In this way, shooter's display 70 provides feedback to the shooter either as the shots are scored, or promptly after the end of a drill.

In the illustrated preferred embodiment, the user interface of shooter's display 70 comprises a shooter's target outline 71 with shooter's hit indicators 72 showing the locations of hits calculated by target module 30 (shown on FIG. 1). If desired, colors, shapes, cross hatching, or symbols can be used to designate the value of each hit as determined by server 50 (shown on FIG. 1). For example, and without limitation, a red circle could be used for a hit in a predetermined target area indicating a kill shot, and a black circle could be used for a hit in a predetermined target area indicating a wounding shot. Numbers can be used to indicate which shot resulted in each hit. The result is that the shooter receives more complete and more detailed information on shooting performance than would be received were the shooter to be given a paper target after the completion of the drill. While shooters display 70 could communicate directly with target modules 30, in the illustrated preferred embodiment, drill data is consolidated with hit data by server 50 (shown on FIG. 1) and then provided to shooter's display 70.

Shooter's display 70 may also conveniently display additional information such shooter's range indicator 73 (which indicates the shooting range on which the drill took place), the shooter's lane indicator 74, and the shooter's target indicator 75. It is common for a shooting range to be divided into lanes for each shooter. Shooter's lane indicator 74 displays the lane to which the shooter was assigned for a drill. While some lanes have only a single target, other lanes may have multiple targets. Where multiple targets are used, it may be convenient to have shooter's target indicator 75 indicate which target is being displayed by shooter's target outline 71. Swiping, buttons, or a variety of other user interface techniques can then allow a shooter to switch shooter's target outline 71 between different targets.

Shooter's display 70 may also conveniently provide certain command functions such as permitting a shooter to log in and identify himself or herself as the shooter for a given drill on a given lane, allowing the shooter to log out when all drills are completed, or allowing the shooter to commence a drill. Shooter's fire button 76, as illustrated in the preferred embodiment, allows a shooter to commence a drill by tapping a button. This is convenient for drills in which both hit times and hit locations are to be recorded. Shooter's save button 78 similarly allows a shooter to save the results of a given drill and prepare for the next drill. Shooter's logout button 79 provides a convenient means for the shooter to log out of shooter's display 70 so that it can be used by another shooter. Shooter's display 70 may optionally display other information as well, such as an identifier for the display (such as a device name or MAC address), the date and time, the coordinates of each shot location, an indication of the shooter's consolidated score and whether it is a passing score or a failing score, and/or an indication of the shooter's ranking among other shooters participating in the same drill or across multiple drills. Shooter's display 70 could also optionally provide additional command functions such as an online/offline button to disconnect and reconnect shooter's display 70 to the network, an emergency shutdown button, or a print or email button to allow the shooter to generate a record of his or her performance on the drill.

Figure 11:
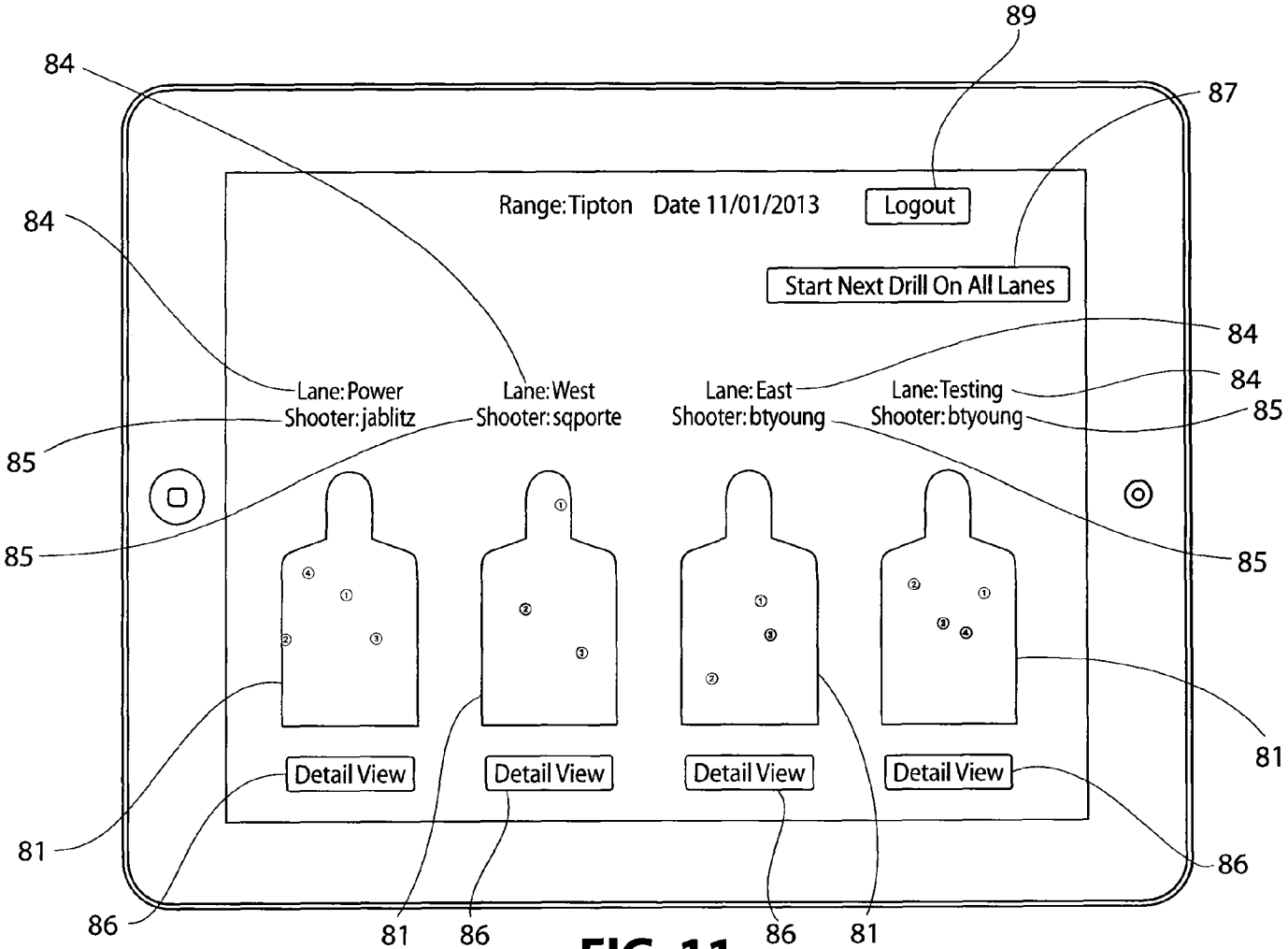
FIG. 11 is a schematic diagram showing the user interface of an embodiment of a range master display suitable for use in the system shown in FIG. 1.

Referring to FIG. 11, a preferred embodiment of range master's display 80 is shown. Here again, the illustrated preferred embodiment is a tablet computer (such as an iPad or Android tablet), but it is understood that a variety of computing devices could be used including without limitation laptop computers, personal computers, cell phones, dumb terminals and custom devices. Range master's display 80 may conveniently be used by a range safety officer to coordinate and monitor shooting drills. Range master's target outlines 81 as shown provide an outline of targets in each shooting lane and may optionally show hit locations on each target. Range master's lane indicator 84 indicates the lane identifiers and range master's shooter indicators 85 indicate the shooter assigned to each lane. Range master's detail button 86 allows the range safety officer to see detailed information on the performance of each shooter and may conveniently show information substantially identical to the information shown on shooter's display 70 (shown on FIG. 10) for each shooter. Range master's start drill button 87 allows the range safety officer to commence a drill, and range master's logout button 89 allows a particular range safety officer to log out of the system. Other information may also be displayed on range master's display 80 including, range master's range indicator 83 (identifying the range and the date) and consolidated scoring information for shooters and drills. Commands made available to a range safety officer on range master's display 80 may optionally include an emergency shutdown button, a selectable list of available drills, and a means to print or email a report showing drill results by shooter together with consolidated scoring information such as average score, low score, high score, drill completion times, and similar statistics and reports. In this way range master's display 80 allows a range safety officer to select drills, monitor the progress of drills, and review drill results.

Figure 12:
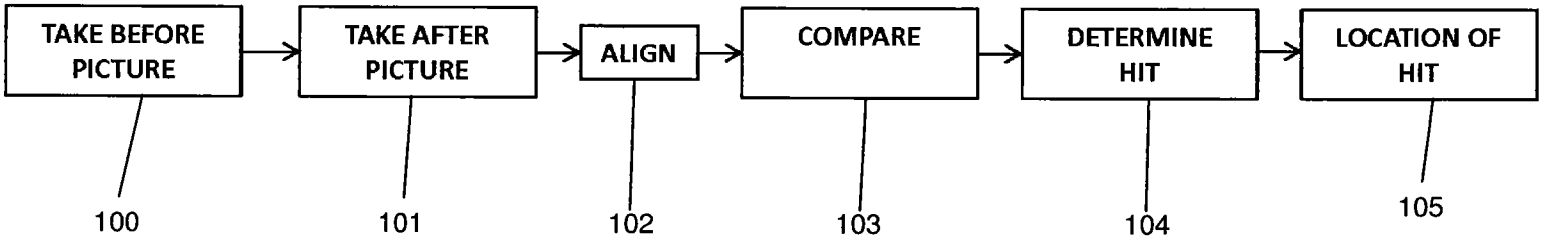
FIG. 12 is a flow chart illustrating an embodiment of a method of detecting shot locations in a target.

Referring to FIG. 12, a flow chart is shown illustrating a method of determining a hit location in a target 20 mounted on a target module 30. Suitable target modules for use with the method include target modules 30, which are shown on FIGS. 1-4 and are otherwise described above. Target 20 (as shown in FIG. 7), has a first layer 22 of a first color and a second layer 24 of a second color. The first color is different from the second color, and said second color comprises shades resulting in an overall color that is substantially red. As shown on FIG. 4, a suitable target module 30 comprises a camera 32 which in the method shown in FIG. 12 is a progressive scan digital camera substantially out of the line of fire adapted to photograph the target 20. An infrared light source 34 is adapted to illuminate target 20. A processor 38 is connected to said camera 32 and is capable of digitally processing images taken from camera 32. Referring again to FIG. 12, the method comprises the steps of causing camera 32 to take a before image in capture before image step 100. Where camera 32 is a video camera, this step may conveniently be performed by causing camera 32 to begin capturing video (which may be done manually or through a command issued by processor 38 shown on FIG. 4). Where camera 32 is not configured to capture a continuous stream of video, this step may conveniently be performed through a command issued by processor 38, shown in FIG. 4, being programmed to trigger an image capture at predetermined intervals or upon receipt of a command from server 50 (shown on FIG. 1). An after image is captured in capture after image step 101. Where camera 32 is a video camera, this step may conveniently be performed by capturing a subsequent frame in the video stream. Where camera 32 is not configured to capture a continuous stream of video, this step may conveniently be performed through a command issued by processor 38, shown in FIG. 4, being programmed to trigger an image capture at predetermined intervals or upon receipt of a command from server 50 (shown on FIG. 1).

In image alignment step 102, processor 38 aligns the target images in the before or after images to account for any movement of target 20 and/or camera 32 between frames. Techniques for aligning images are known in the art, and examples of suitable techniques have been described above.

In Before-After compare step 103 processor 38 performs a comparison (which may conveniently be a subtraction) of the before image from the after image. Shot locations can then be determined in hit location detection step 104, which may conveniently be accomplished by programming processor to determine a hit location by detecting the appearance of the second color in the after image that was not in the before image by digitally processing the comparison using image processing techniques.

In location transmission step 105, the hit location is transmitted to a user or to a server. This step may be done in real time, or may be delayed until a predetermined time or until receipt of an indication that a drill has ended. Transmission may conveniently be accomplished by processor 38 transmitting hit coordinates over a network (such as a wireless local area network or a wide area network such as the Internet), to a user or to a server such as server 50 (shown in FIG. 1). Once transmitted, hit results can be stored for later analysis and reporting or could be displayed to a shooter or a range safety officer or to a performance evaluator.

Other variations and embodiments of the present invention will be apparent to those of ordinary skill in the art in light of this specification, all of which are within the scope of the present invention as claimed. Nothing in the foregoing description is intended to imply that the present invention is limited to any preferred embodiment described herein.

We claim:

1. A shooting range target system comprising a target module adapted to receive a target;

said target having a first layer of a first color and a second layer of a second color, said first color being different from said second color; and said target module comprising a digital camera substantially out of the line of fire adapted to capture images of said target, a movement sensor in operable connection with said target, a processor connected to said movement sensor and to said camera, and a network interface connected to said processor;

wherein substantially upon a bullet creating a hole through said target a portion of said second layer becomes visible to said camera, said processor determines the hole location by comparing a before image generated by said camera and an after image generated by said camera, correcting for movement of said target using information from said movement sensor, and detecting appearance of said second color, and said processor transmits the hole location over a network through said network interface.

2. The shooting range target system of claim 1 wherein said second color is red.

3. The shooting range target system of claim 2 further comprising a long wavelength infrared light source adapted to illuminate said target to enhance the appearance of said second color to said camera.

4. The shooting range target system of claim 2 further comprising an infrared light source adapted to illuminate said target to enhance the appearance of said second color to said camera.

5. The shooting range target system of claim 1 further comprising a light source adapted to illuminate said target, said light source being capable of emitting frequencies of light that enhance the illumination of said second color.

6. The shooting range target system of claim 1 wherein said target module further comprises a movable mounting adapted to receive said target, said movable mounting being connected to said processor and said processor being adapted to deploy said movable mounting.

7. The shooting range target system of claim 1 wherein said camera is a progressive scan camera.

8. The shooting range target system of claim 1 wherein said processor is further programmed to determine a first edge location of at least one edge of said target in the before image and a second edge location of the same said edge of said target in the after image and to compare said first edge location and said second edge location to determine the extent to which said target moved between said before image and said after image.

9. The shooting range target system of claim 1 further comprising a server comprising a network interface and programmed to calculate a score based on the hole locations transmitted by said processor.

10. The shooting range target system of claim 9 further comprising multiple said target modules wherein said server is programmed to calculate a separate score for each said target module.

11. The shooting range target system of claim 1 further comprising a shooter's display comprising a network interface and adapted to communicate a score to a shooter based on hole locations transmitted by said processor.

12. The shooting range target system of claim 1 further comprising a plurality of said target modules and a range master's display comprising a network interface and adapted to communicate a score for each said target module to a range master based on hole locations transmitted by said processor.

13. The shooting range target system of claim 1 wherein said movement sensor is a rotation sensor adapted to detect rotation of said target about an axis substantially perpendicular to the face of said target.

14. The shooting range target system of claim 1 wherein said camera is adapted to view said target from below at an angle of no more than sixty degrees.

15. The shooting range target system of claim 1 further comprising a motor operably connected to said processor and adapted to move said target module from a first location to a second location substantially upon receipt of a command from said processor.

16. The shooting range target system of claim 15 wherein said target module is supported by substantially parallel tracks having a track gear path and said motor comprises a gear adapted to engage said gear path.

17. The shooting range system of claim 15 wherein said target module is supported by wheels and at least one of said wheels is adapted to be driven by said motor.

18. A shooting range target system comprising a target having a first layer of a first color and a second layer of a second color, said first color being different from said second color;

a target module comprising a processor, a moving mount operably connected to said processor and adapted to receive said target and deploy said target at times determined by said processor, a digital camera substantially out of the line of fire and operably connected to said processor and adapted to capture images of said target, a light source adapted to illuminate said target with frequencies of light that enhance the appearance of said second color, a movement sensor operably connected to said target and said processor, and a processor network interface operably connected to said processor;

a server comprising a server network interface and being programmed to send commands to said processor through said server network interface directing said processor to deploy said target, and to receive hit locations from said processor through said server network interface;

a range master display comprising a range master display network interface and being programmed to receive said hit locations from said server and display said hit locations to a range safety officer; and a shooter display comprising a shooter display network interface and being programmed to receive said hit locations from said server and display said hit locations to a shooter;

wherein substantially upon receiving a command from said server, said processor deploys said target;

substantially upon a bullet creating a hole through said target a portion of said second layer becomes visible to said digital camera;

said processor determines said hit locations by comparing a before image generated by said digital camera and an after image generated by said digital camera, correcting for movement of said target using information from said movement sensor, and detecting appearance of said second color;

said processor transmits said hit locations to said server through said processor network interface; and said server transmits said hit locations to said range master display and said shooter display through said server network interface.

19. The shooting range target system of claim 18 wherein said second color is red;

said light source is a long wavelength infrared light source; and said movement sensor is a rotation sensor adapted to detect rotation of said target.

20. The shooting range target system of claim 18 comprising a plurality of said target modules wherein said server is programmed to cause said processor to deploy said targets in a sequence and to generate a score for each shooter by comparing said hit locations to predetermined regions on said target.

21. The shooting range target system of claim 20 wherein said server is further programmed to cause said processor to retract said targets substantially upon receiving at least one hit location on said target in one of said predetermined regions.

22. The shooting range system of claim 18 wherein said camera is adapted to view said target from the side at an angle of no more than fifty degrees.

23. A method of determining a hit location in a target mounted on a target module wherein said target has a first layer of a first color and a second layer of a second color, said first color being different from said second color;

said target module comprises a progressive scan digital camera substantially out of the line of fire adapted to photograph said target;

a processor operably connected to said camera;

said method comprising the steps of causing said camera to take a before image;

causing said camera to take an after image; and causing said processor to compare said before image and said after image and to determine said hit location by detecting the appearance of said second color in said after image that did not appear in said before image.

24. The method of claim 23 wherein said second color is red.

25. The method of claim 24 wherein said target module further comprises a long wavelength infrared light source adapted to illuminate said target.

26. The method of claim 23 wherein said target module further comprises a network interface operably connected to said processor further comprising the step of causing said processor to transmit said hit location over a network through said network interface.

27. The method of claim 23 wherein said target module further comprises a rotation sensor operably connected to said processor and adapted to detect rotation of said target; and said before image and said after image are created from a plurality of scans from said progressive scan camera; and further comprising the step of causing said processor to align said scans based on rotation sensed by said rotation sensor between said scans.

28. The method of claim 23 further comprising the steps of causing said processor to detect a before image edge of said target in said before image and a corresponding after image edge of said target in said after image, and to align said before image and said after image by correcting for movement of said target detected by comparing said before image edge and said after image edge.

* * * * *